US006240701B1

(12) United States Patent
Moses et al.

(10) Patent No.: US 6,240,701 B1
(45) Date of Patent: Jun. 5, 2001

(54) BUILDING PANEL AND METHOD AND APPARATUS OF FORMING SAME

(75) Inventors: Paul Russell Moses, Cronulla; Robert Lawrence Munn, Killarney Heights; Robert Story, Lovett Bay, all of (AU)

(73) Assignee: Boral Resources (NSW) Pty Limited, South Wentworthville (AU)

( * ) Notice: Subject to any disclaimer, the term of this patent is extended or adjusted under 35 U.S.C. 154(b) by 0 days.

(21) Appl. No.: 09/486,319

(22) PCT Filed: Aug. 28, 1998

(86) PCT No.: PCT/AU98/00706

§ 371 Date: Jul. 25, 2000

§ 102(e) Date: Jul. 25, 2000

(87) PCT Pub. No.: WO99/11442

PCT Pub. Date: Mar. 11, 1999

(51) Int. Cl.[7] ..... E04B 1/00; E04G 21/00; E04G 23/00

(52) U.S. Cl. ..... 52/745.19; 52/742.1; 52/742.14; 52/797.1; 52/309.12; 52/783.1; 264/256; 264/255

(58) Field of Search ..... 52/745.19, 742.1, 52/742.14, 742.13, 745.15, 797.1, 309.12, 309.17, 783.1; 264/256, 255

(56) References Cited

U.S. PATENT DOCUMENTS

| | | | |
|---|---|---|---|
| 3,809,516 | 5/1974 | Komaki . | |
| 4,191,521 | 3/1980 | Muldery et al. . | |
| 4,409,768 * | 10/1983 | Boden | 52/309.4 |
| 5,209,968 | 5/1993 | Sweeney . | |

* cited by examiner

*Primary Examiner*—Carl D. Friedman
*Assistant Examiner*—Chi Q Nguyen
(74) *Attorney, Agent, or Firm*—McDonnell Boehnen Hulbert & Berghoff

(57) ABSTRACT

A building panel includes a central core and a pair of opposed coating surfaces formed integrally with the core. The method of forming the building panel includes the application of a flowable, settable coating material to respective surfaces of at least two baffles (100), placing the baffles in a substantially parallel, spaced interrelationship, at least substantially filling the space between the two baffles (100) with a settable core material prior to setting of the core material, and allowing the core material and coating material to set.

21 Claims, 15 Drawing Sheets

BUILDING PANEL AND METHOD AND APPARATUS OF FORMING SAME

FIELD OF THE INVENTION

The following invention relates to a method and apparatus for forming a building panel. The invention also relates to a building panel.

Lightweight concrete building panels are known. Such panels are produced in a raw, unfinished condition for installation. After being installed into a building under construction, the panels are rendered or otherwise coated to provide an acceptable surface finish. This process requires the labour of a skilled renderer in applying the rendered finish with a trowel. Furthermore, the strength of such known lightweight concrete panels is not high.

OBJECT OF THE INVENTION

It is an object of the present invention to overcome or substantially ameliorate at least one of the above disadvantages and/or more generally to provide an improved building panel and a method and apparatus for forming a building panel.

DISCLOSURE OF THE INVENTION

There is disclosed herein a method of forming a building panel or panels, the method including:

- applying a flowable, settable coating material to respective surfaces of at least two baffles,
- placing the baffles in a substantially parallel, spaced interrelationship,
- at least substantially filling the space between the two baffles with a settable core material prior to setting of the coating material, and
- allowing the core material and coating material to set.

Preferably, the baffles are located with respect to one another prior to filling the space with core material.

Alternatively, the baffles can be moved together after filling the space with core material but prior to setting of the core material and coating material.

Preferably, the baffles are moved apart and/or separately removed after setting of the core material and coating material so as to release the formed panel(s).

Preferably, the method further provides n+1 baffles in a parallel spaced interrelationship, between which n panels are formed where n equals any integer greater than or equal to 1.

Preferably, after the baffles are moved apart, the panels are removed in a direction substantially parallel to the plane of the baffles by application of force thereto.

Preferably, the baffles are located within a mould box or supporting frame.

Preferably, the baffles are moved toward one another by means of hydraulic clamping cylinders.

There is further disclosed herein an apparatus for use in forming a building panel in accordance with the above disclosed method, the apparatus including:

- a mould box or supporting frame into which said coated baffles are receivable,
- means to locate said coated baffles in association with one another so as to define a minimum space therebetween, and
- means to apply a settable core material between each of said baffles.

Preferably, the apparatus further includes a means to apply a coating material to both sides of at least some of said baffles prior to applying said settable core material between each of said baffles.

Preferably, each baffle is substantially hollow, having a pair of spaced apart side sheets.

Preferably, each baffle has air inlet means by which air can be injected to the space between the sheets so as to outwardly expand the same under pressure to assist in releasing the set panels from the baffles.

Alternatively, each baffle is solid. Plywood is a suitable material for a solid baffle. The plywood can be plastics coated. As a further alternative, the baffles can be a composite of plywood, nylon, PVC and steel.

Preferably, the baffles have extraction engagement holes to which an extraction device can be anchored for the purpose of applying force to the set panels for removal.

Preferably, said mould box or supporting frame is formed upon a mobile structure.

Preferably, the mobile structure has one or more posts to which clamping cylinders are affixed, said clamping cylinders being associated with side walls of the mould box or supporting frame.

Preferably, the side walls of the mould box or supporting frame act as end baffles.

There is further disclosed herein a plant for forming building panels, the plant including:

- means for applying a flowable, settable coating material to respective surfaces of at least two baffles,
- means for placing the baffles in a substantially planar, spaced interrelationship,
- means for substantially filling the space between the two baffles with a settable core material prior to setting of the coating material, and
- means for conveying the individual panel throughout the plant for the purpose of cleaning and coating the same with said settable coating material and for arranging the coated baffles in said substantially parallel, spaced interrelationship.

Preferably, the plant also includes means for conveying a mould box or supporting frame into which and from which the baffles are inserted and removed and means for transferring the mould box from a first, baffle removal position to a second baffle insertion position, between which positions the mould box or supporting frame is rotated.

Preferably, the means for substantially filling the space between the two baffles with a settable core material includes a hopper from which there extends one or more filling tubes, the hopper being mounted upon a frame and being pivotable about a horizontal axis, the hopper being adapted to be raised and lowered such that the filling tubes enter and are withdrawn from a space between adjacent baffles while core material is being delivered thereto by said filling tubes.

Preferably, means are provided to oscillate the hopper horizontally, during vertical withdrawal of the tubes and delivery of the core material.

There is further disclosed herein a building panel formed by the above disclosed method or by use of the above disclosed apparatus or as produced by the above disclosed plant.

There is further disclosed herein a building panel including a core having been set from a settable core material and a coating on either side thereof, the coating on either side having been set from a settable coating material concurrently with setting of said core material.

BRIEF DESCRIPTION OF THE DRAWINGS

Preferred methods of the present invention will now be described by way of example with reference to the accompanying drawings which depict a preferred apparatus for use in the method, wherein.

DESCRIPTION OF THE PREFERRED EMBODIMENTS

Figure 1:
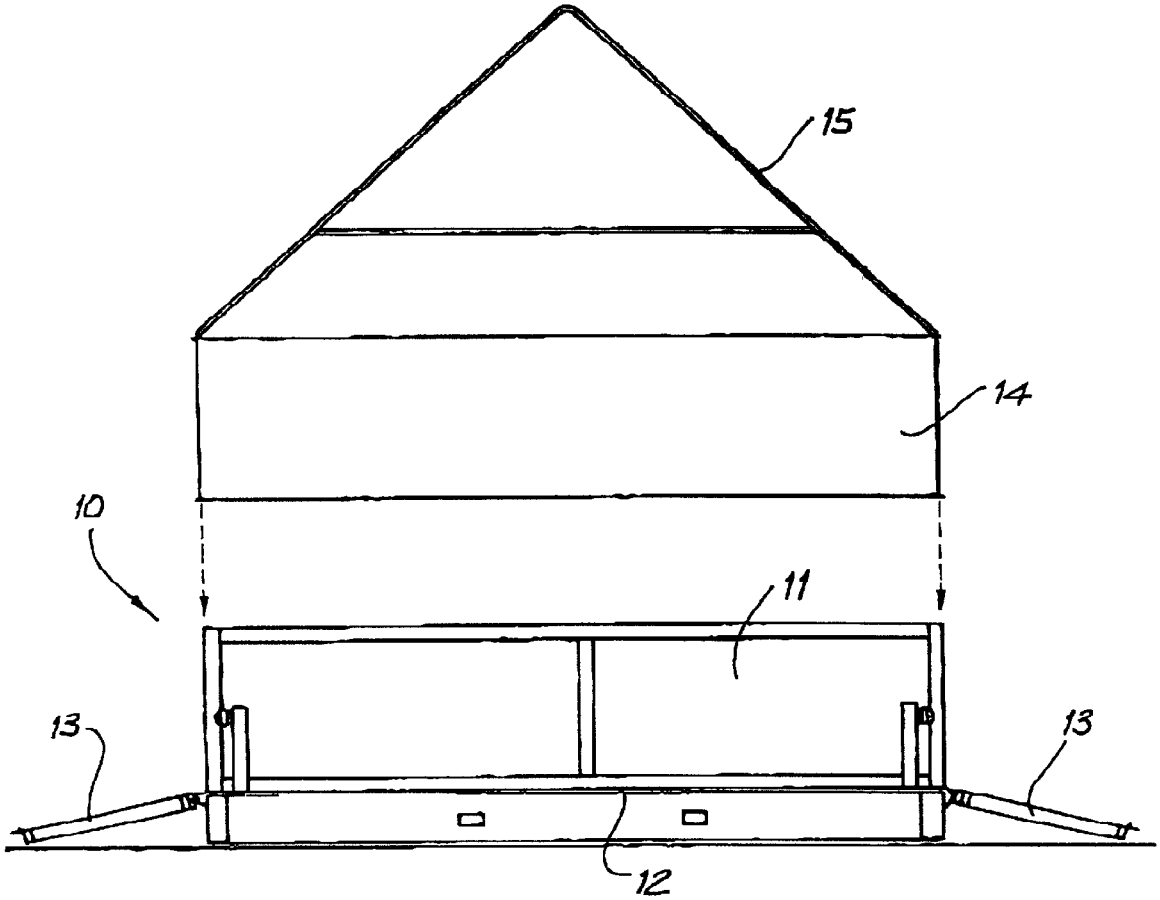
FIG. 1 is a schematic side elevational view of a mould box or supporting frame having a baffle lifted therefrom by means of a lifting frame, the mould box or supporting frame shown with its end doors open.

In FIGS. 1 to 6A of the accompanying drawings there is schematically depicted a mould box or supporting frame 10. Mould box 10 has a pair of side walls 11, a bottom 12 and a pair of solid end doors 13. Walls 11, bottom 12 and end doors 13 define a cavity into which a number of baffles 14 can be inserted.

The sides 11, bottom 12 and end doors 13 are preferably fabricated from solid steel or other metal or strong material. The end doors 13 are hinged at the bottom edge thereof to the bottom 12. The doors open outwardly and downwardly as shown in FIG. 1. The baffles 14 fit neatly into the mould box or supporting frame 10 and divide the mould cavity into sections, i.e., individual cavities between respective baffles into which building panels are cast.

The internal length of the mould box or supporting frame determines the panel length which is typically 2.6 m. The internal height of the mould box or supporting frame determines the panel width which is typically 0.6 m. The spacing between the inserted baffles is set by means of spacers 22 which are typically 75 mm wide. That is, the space between the baffles is typically 75 mm. It should be appreciated however that these dimensions can vary depending on the required panel dimensions.

Figure 5:
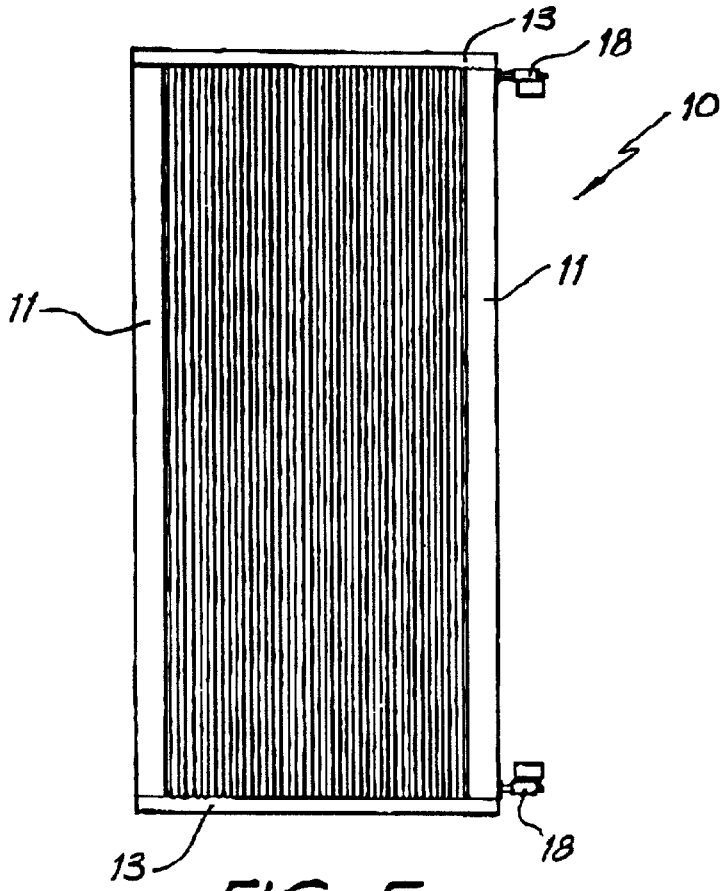
FIG. 5 is a schematic plan view of the mould box or supporting frame of FIGS. 1, 3 and 4 with the baffles in place.
Figure 5A:
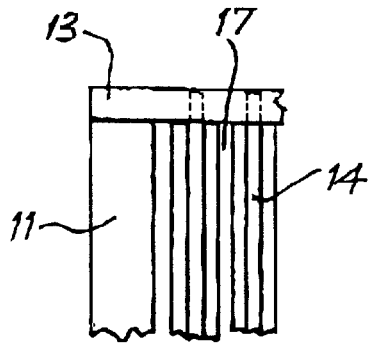
FIG. 5A is a schematic exploded illustration of a portion of the structure depicted in FIG. 5.

As illustrated, the mould box or supporting frame is situated upon a mobile base 20 has wheels 23. A pair of posts 19 extends upwardly from the mobile base 20. To each post 20 there is affixed an hydraulic clamping cylinder 18. Clamping cylinder 18 cooperates with one of the side walls 11 as shown in FIG. 5. The opposing side wall 11 is affixed to the base 20.

Figure 2:
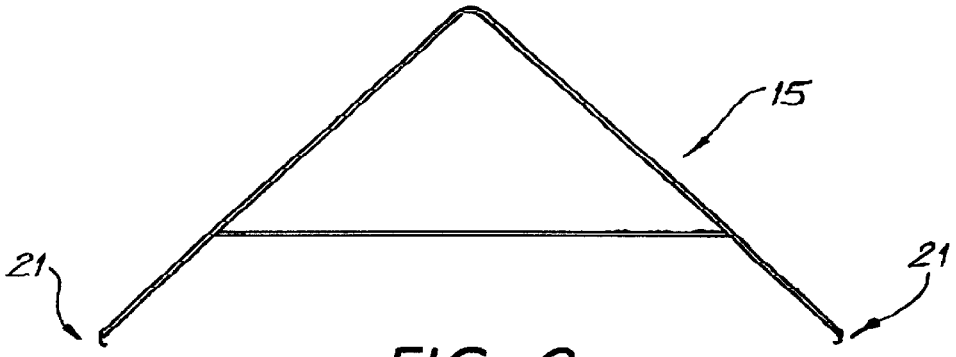
FIG. 2 is a schematic elevational view of the lifting frame of FIG. 1.
Figure 3:
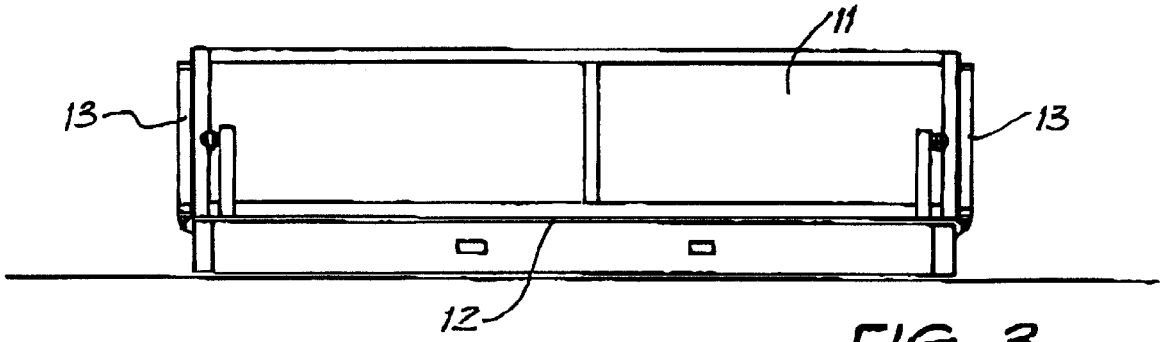
FIG. 3 is a schematic elevational view of the mould box or supporting frame of FIG. 1 with the end doors closed.
Figure 4:
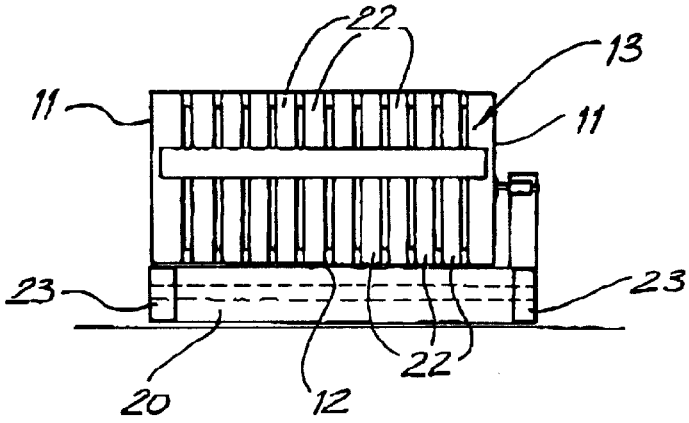
FIG. 4 is a schematic end elevational view of the mould box or supporting frame of FIG. 1 with baffles in place therein.

A lifting frame 15 as shown in FIG. 2 has a pair of hooks 21 at its lower extremities. These hooks 21 are adapted to cooperate with individual baffles 14 for the purpose of lifting the same out of the mould box or supporting frame. The lifting frame 15 can be raised and lowered by means of an overhead pulley system or crane for example.

Figure 6:
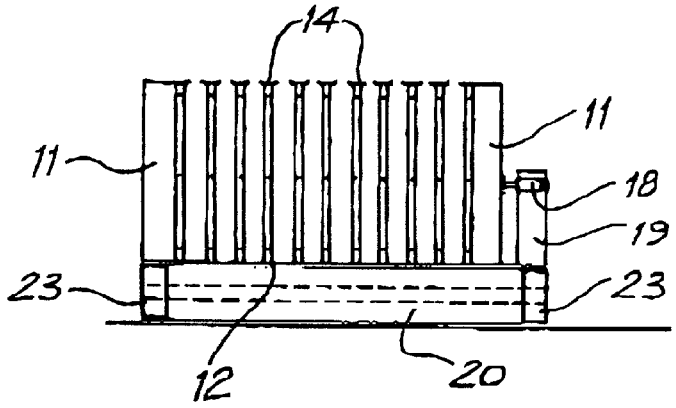
FIG. 6 is a schematic end elevational view of the mould box or supporting frame.
Figure 6A:
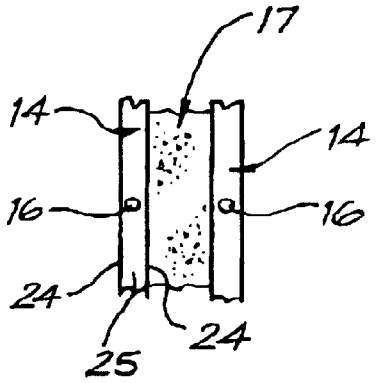
FIG. 6A is a schematic exploded partial view of a pair of baffles having a panel formed therebetween.
Figure 8:
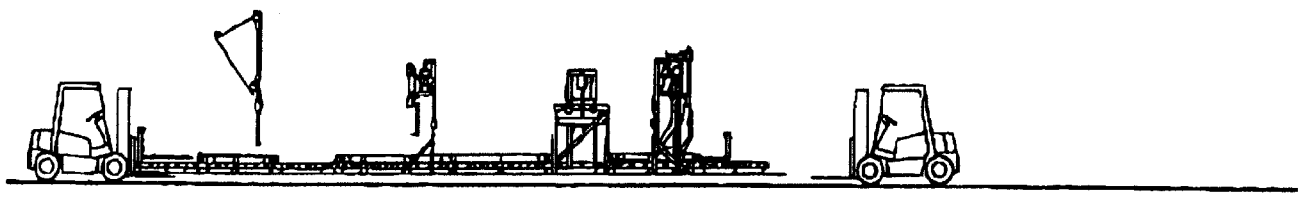
FIG. 8 is a schematic cross-sectional elevational view of the plant layout of FIG. 7 taken at A—A in FIG. 7.

With reference to FIG. 6A, each baffle 14 has a pair of spaced apart sheets 24 defining a space 25 therebetween. Sheets 24 are preferably steel or other metal such as aluminium. The sheets are intended to be substantially planar, though capable of flexing under the application of internal air pressure to the cavity 25. Each baffle 14 has an extraction engagement hole 16, the purpose of which shall be described below.

In use of the apparatus as described above, building panels can be fabricated as follows.

By use of an appropriate pulley or crane system, the lifting frame 15 can be raised so as to raise an individual baffle 14 from the mould box or supporting frame 10. The baffle 14 can then have applied thereto a coating. The coating as applied to the surfaces of the baffles 14 is typically 3 mm thick. However, this dimension can vary depending on particular applications. Typically, the coating is applied by a spraying technique, typically using apparatus of a type, though smaller than, spray guns used for concrete pool finishing and in the mining industry and sold under the trade mark "Shotcrete".

The coating material typically has a blend of sand, cement, water and a cross-linking polymer emulsion. The coating material can also include supplementary cementitious materials. Typically, the cross-linking polymer emulsion is sourced from National Starch and Chemicals Pty Ltd. However, there are many other polymers available and suitable for use in the present process. The emulsion is typically used as a concrete additive for repair and patching of concrete. The emulsion is used as a partial replacement for water to give flexibility and added tensile strength to the coating applied to the opposed planar surfaces of the baffles 14. The cross linking polymer emulsion is used as a partial replacement for water to give flexibility and added tensile strength to the spray mortar skin. Optional additives to the coating material include fibres, typically polypropylene fibres as used in concrete crack control, coloured oxides, silica fume and flyash. The coating material can be modified to suit any local materials or finished panel requirements.

Irrespective of the emulsion used, the coating materials in general should display good adhesion to the core material, good tensile strength, flexibility, water resistance and provide a durable surface to the finished panel.

With the end doors 13 in the closed position, the baffle 14 is inserted into the mould box or supporting frame 10. Alternatively, the baffles can be placed first, then the doors closed to assist in aligning the baffles into precise position. At this stage, lifting rods are also inserted into the end doors for the purpose of assisting with removal of the panels after hardening. The spacers 22 are then positioned alongside the baffle. The coating and inserting steps are repeated for the desired number of baffles.

The clamping cylinders 18 are then activated to force one of the side walls 11 toward the other until such time as the spaces between the respective baffles is limited by their engagement with the respective spacers 22.

Whilst the sprayed coating is still fresh, the core mix is added to the cavities between the baffles. The mixture used for the core material typically has sand, cement, water, an air entraining agent and a lightweight aggregate, typically coated polystyrene beads, possibly of the type known as BST. The core material can also contain supplementary cementitious materials and/or chemical admixtures. The air entraining agent can be a commercially available admixture. The BST material has expanded polystyrene, chemically coated beads.

Whilst maintained in position, the wall panels are allowed to cure, typically over an 18 hour period. The coating material thus fuses with the core material to provide a strong integral wall panel.

After curing, the clamping cylinders 18 are released so as to remove lateral pressure from the walls 11 and baffles 14. To assist in detaching the set panels from the baffles, air can be applied under pressure to the space 26 between the respective opposed sheets 24 of the baffles 14. As a result the sheets 24 will flex outwardly, detaching the panels 17 therefrom.

Upon opening of the end doors 13, access is gained to the ends of the baffles 14 and formed panels 17. A hand held pneumatic cylinder has a pair of hooks is then used to push the individual panels 14 out of the mould box or supporting frame. To this end, the hooks on the pneumatic cylinder can be engaged with the extraction engagement holes 16 at the ends of each baffle 14. A pushing element or foot of the cylinder is then engaged with the end surface of the panel 17 to push the same out through the opposed opened door region of the mould box or supporting frame. That is, the reaction force associated with this pushing action is transferred to the baffles 14 by interengagement of the hand held tool with the baffles 14. The extraction cylinder is held like a riffle by an operator. With both doors 13 open, and upon activation of a trigger, the pushing foot pushes the concrete panel out through one of the open doors 13 to be received by a pallet for dispatch.

It should be appreciated that modifications and alterations obvious to those skilled in the art are not to be considered as beyond the scope of the present invention. For example, the baffles 14 might have an internal frame structure to prevent the opposed sheets 24 from closing towards one another during the application of force by clamping cylinders 18. Also, the extraction engagement hole 16 might also serve as a means of applying the required internal pressure to the baffle cavity 25 to release the formed panels 17.

Furthermore, the extraction cylinder might have two triggers or a two-pull trigger action, one activation of the trigger, or one of the triggers, serving to activate engagement hooks, and the other acting to activate the pushing foot to extract the formed panel.

Typically, the pushing foot pushes the formed panels through a distance of about 300 mm for the purpose of allowing access for manual lifting to the pallet.

As an additional feature, steel or other reinforcing mesh or other reinforcing means can be positioned between the baffles to be surrounded by the core material. A further feature can be the fitting of a profiler which can trim the edge of the panel as cast and provide a detail such as a tongue and groove to the edge.

In FIGS. 7 to 13 of the accompanying drawings there is schematically depicted the plant layout and other detail associated with a modified method and apparatus for forming building panels. FIGS. 11A, 12B, 13A and 13B show further modified apparatus. This plant layout is designed for higher production throughput than is the case as discussed above with reference to FIGS. 1 to 6A. The overall method is similar to that described above with reference to FIGS. 1 to 6A.

In the plant of FIGS. 8 to 13, the baffles no longer include a pair of spaced metal sheets, but instead are formed as a single sheet of material or laminated solid layers of material. Typically, a single sheet of plastics coated plywood forms each baffle 14. The plant layout of FIGS. 7 and 8 can be described as follows. The individual baffles are placed in a mould box or supporting frame 70 and carried by a fork lift to a chain drive conveyor 71. The individual baffles are then picked up by a baffle unloading hoist 72 and conveyed in the direction indicated by arrow A along a suspended pipe conveyor 73. The pipe conveyor conveys individual baffles to a cleaning and oiling station 74 where the baffles are cleaned and coated with oil which acts as a mould release agent. The individual baffles are then conveyed to spraying station 75 where the individual baffles are coating material on both sides with a coating material. The panels are then conveyed by the pipe conveyor to the core filling station 76. During the time that the baffles are conveyed by the pipe conveyor 73. The empty mould box or supporting frame 70 is conveyed by a chain drive or other conveyor apparatus to a rotation station 77 where the mould box or supporting frame 71 is rotated through 180° and then further conveyed by the conveyor belt or chain drive conveyor the core filling station 76. At the core station 76, the mould box or supporting frame receives the cleaned, oiled and coated baffles for core filling.

A core filling apparatus receives the filler material from a mixer 79.

Figure 7:
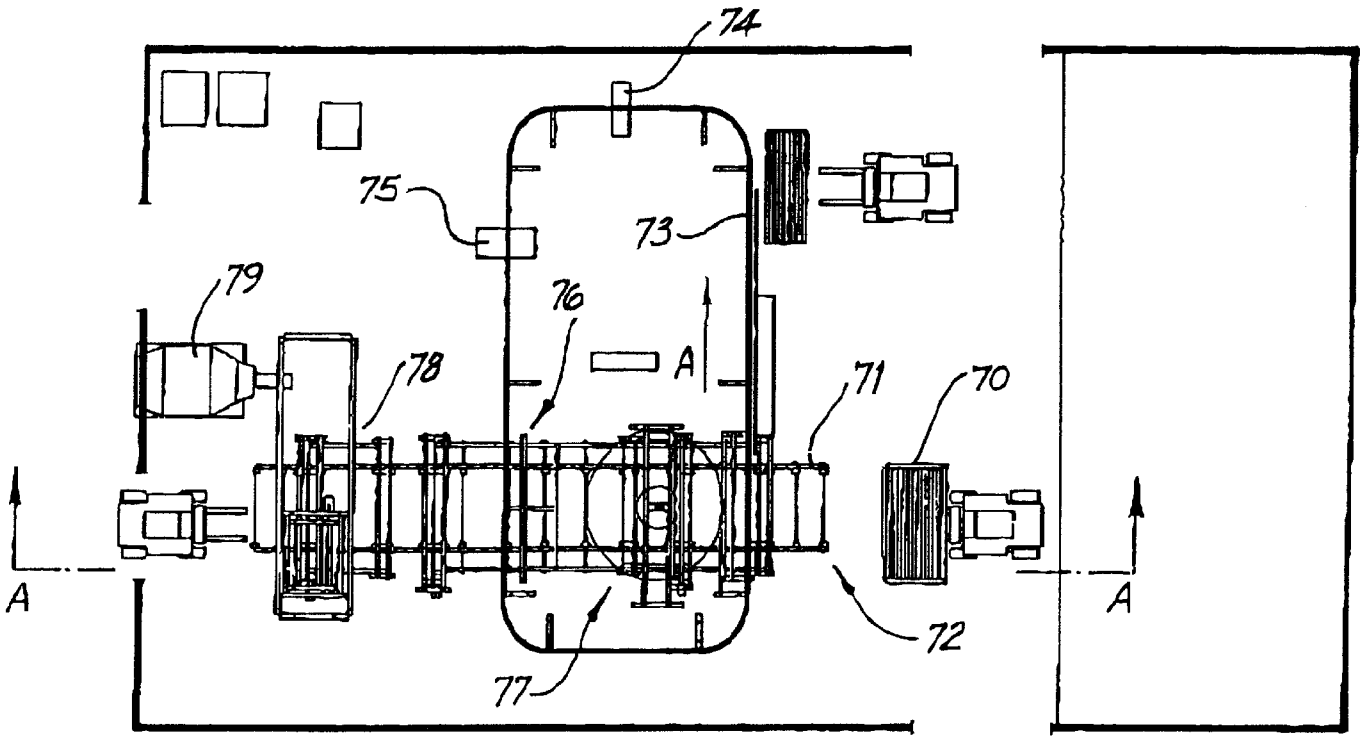
FIG. 7 is a schematic general plant layout.
Figure 7A:
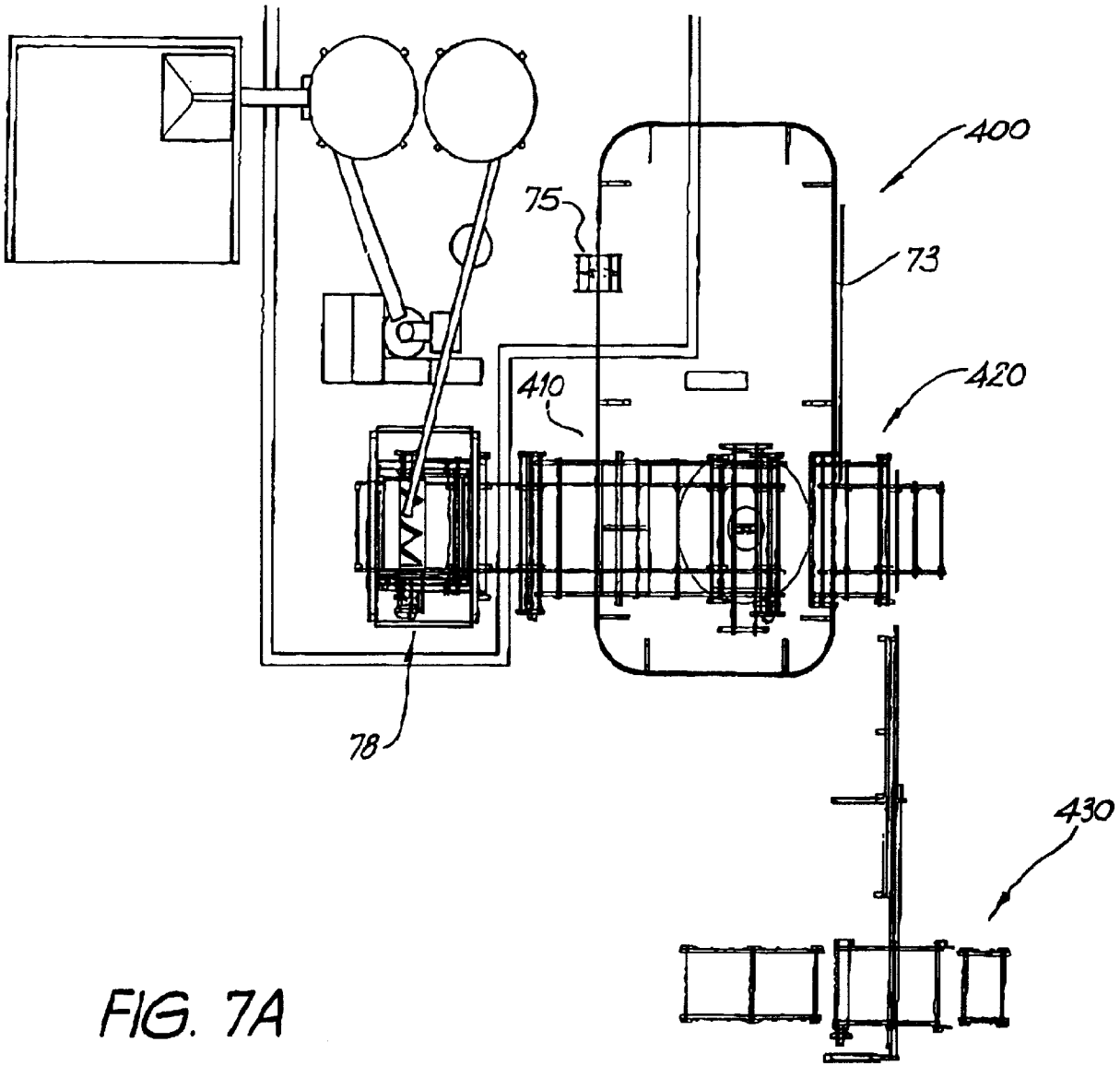
FIG. 7A is a schematic general plant layout of a modified plant.
Figure 9:
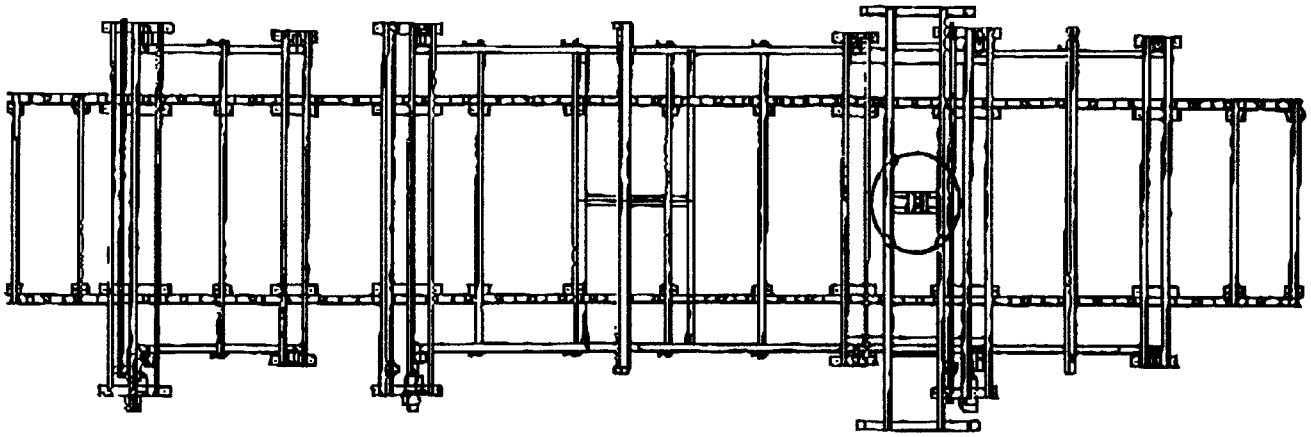
FIG. 9 is a schematic plan view of a conveyor layout.

In FIG. 7A, there is schematically depicted in plan view a modified plant layout. FIG. 7A shows the baffle preparation station 400, the spray station 75, the mould assembly station 410, the mould filling station 78, a demoulding and mould disassembly station 420 and an edge detailing and palletising station 430. The baffles 14 are suspended from a monorail 73 that is used to transport the individual baffles through the process stations 400, 75 and 410. Individual baffles are cleaned, oiled and generally prepared such that they can receive the settable coating material and can be separated from the moulded panel after it has cured.

Figure 14A:
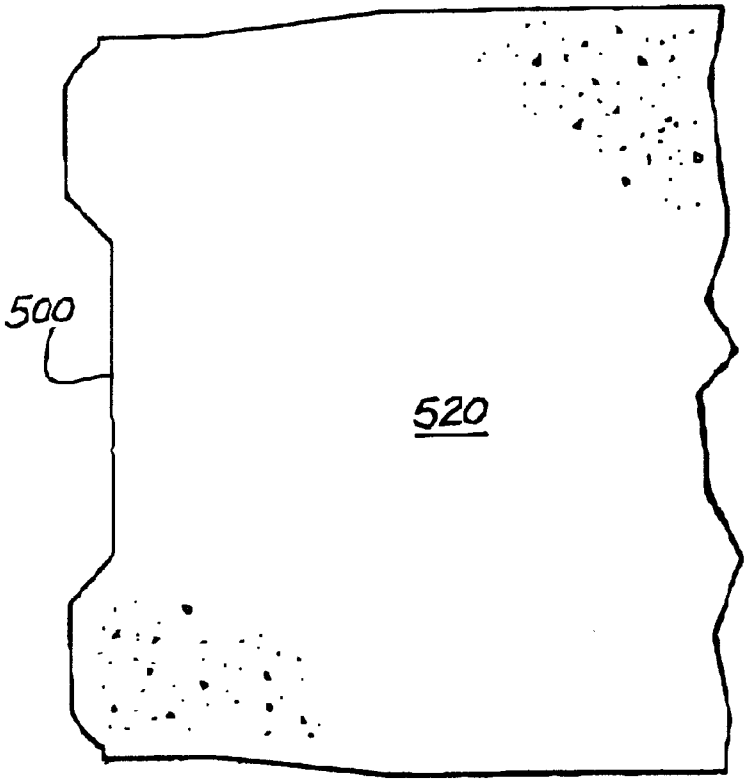
Figure 14:
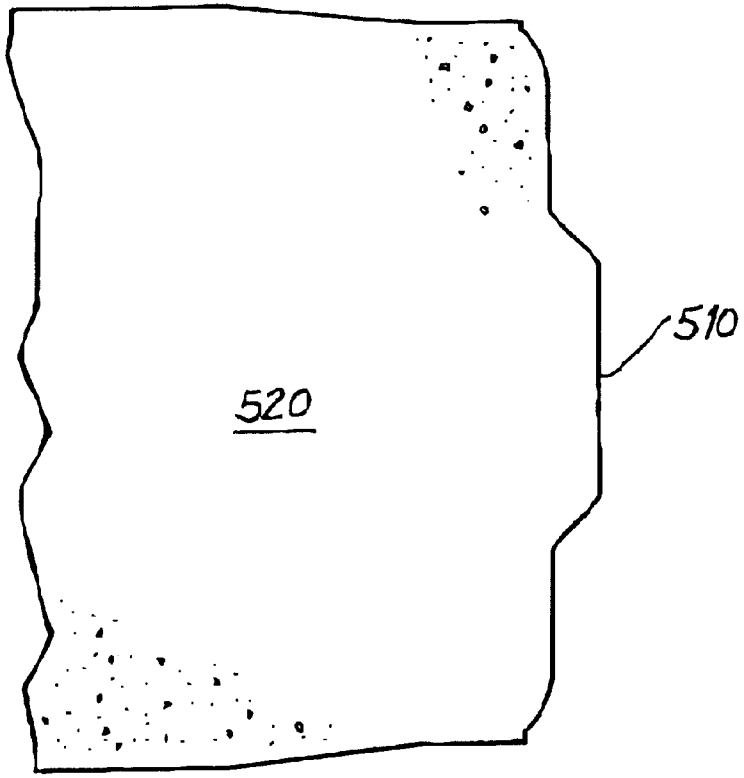

Demoulding and mould disassembly which occurs at station 420 takes place as follows. Once the panels are sufficiently cured and hardened, the still full moulds are disassembled to remove the panels. The baffles and panels are progressively stripped from the mould frame. The device and operators first take off the outermost baffle and replace it on the monorail as at the beginning of the process. The device and operators then separate the outermost panel from the mould frame and deliver it to the edge detailing and palletising station (FIG. 14 and FIG. 14A). The process is repeated until all of the full mould has been disassembled and the formed panels removed and delivered to the detailing station.

Features of the edge detailing and palletising station are shown in FIGS. 14 and 14A. The formed panels are delivered to the edge detailing and palletising station to be completed. The edge detailing station uses a grinding wheel to create a groove 500 in one long edge of the panel to match the tongue 510 that is formed in the opposite long edge of the panel during the casting process. Once the panels have edge details complete, they are palletised for final curing and ultimate delivery to the customer. In some cases, the panels are cut to different sizes prior to palletising. The panels are indicated by reference 520 in FIG. 14 and FIG. 14A. The finished panels have a surface finish thereon to determine by the surface texture of the baffles. The settable core material melds to some degree with the skin material and provides a hard wearing and durable surface in the finished panel which does not require subsequent rendering or in situ cosmetic treatment.

Figure 10:
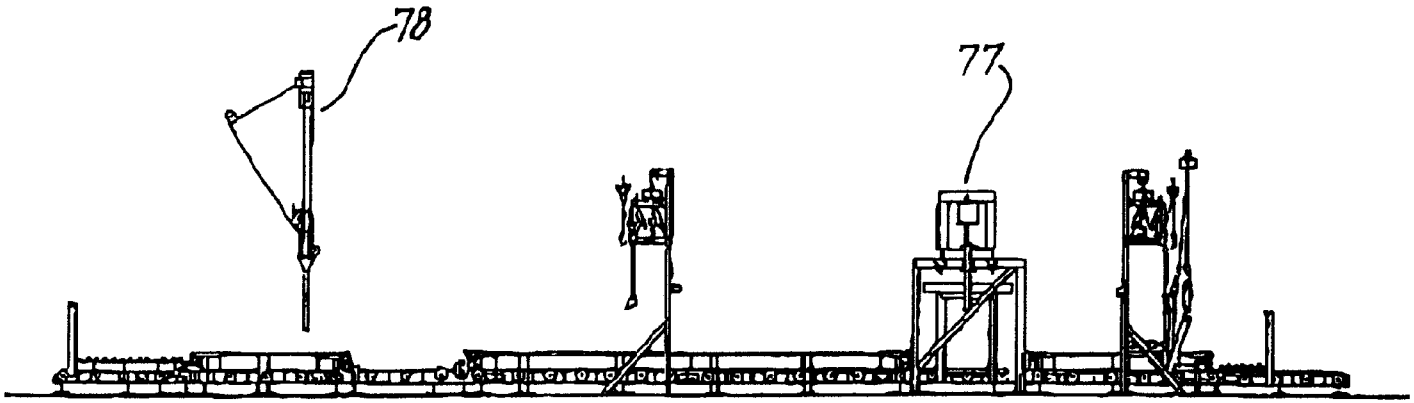
FIG. 10 is a schematic elevational view of the conveyor layout of FIG. 9.
Figure 10A:
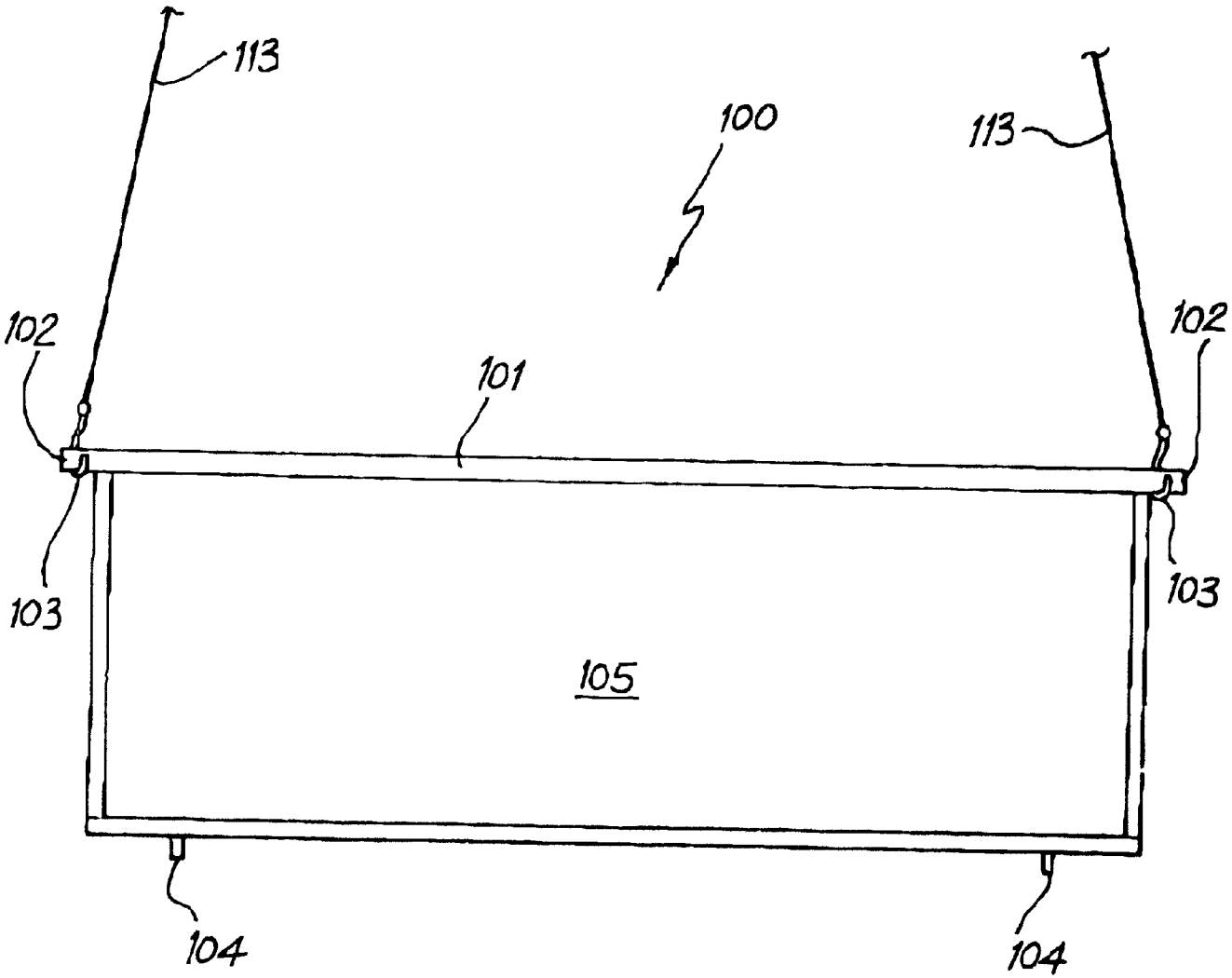
FIG. 10A is a schematic elevational view of a baffle.

In FIG. 10A, there is schematically depicted an individual baffle 100 which includes a plywood panel 105 surrounded by a steel frame 101. At the upper part of the steel frame 101, there extends a pair of projections 102 which are engaged by hooks suspended from the pipe conveyor. At the bottom of each baffle 100 there projects a pair of mould box or supporting frame alignment lugs 104 which serve to engage with a locating track 135 in the bottom of the mould box or supporting frame, which locating track includes recesses 136 which are spaced by a set distance defining the thickness of a panel to be moulded between the baffles.

Figure 11:
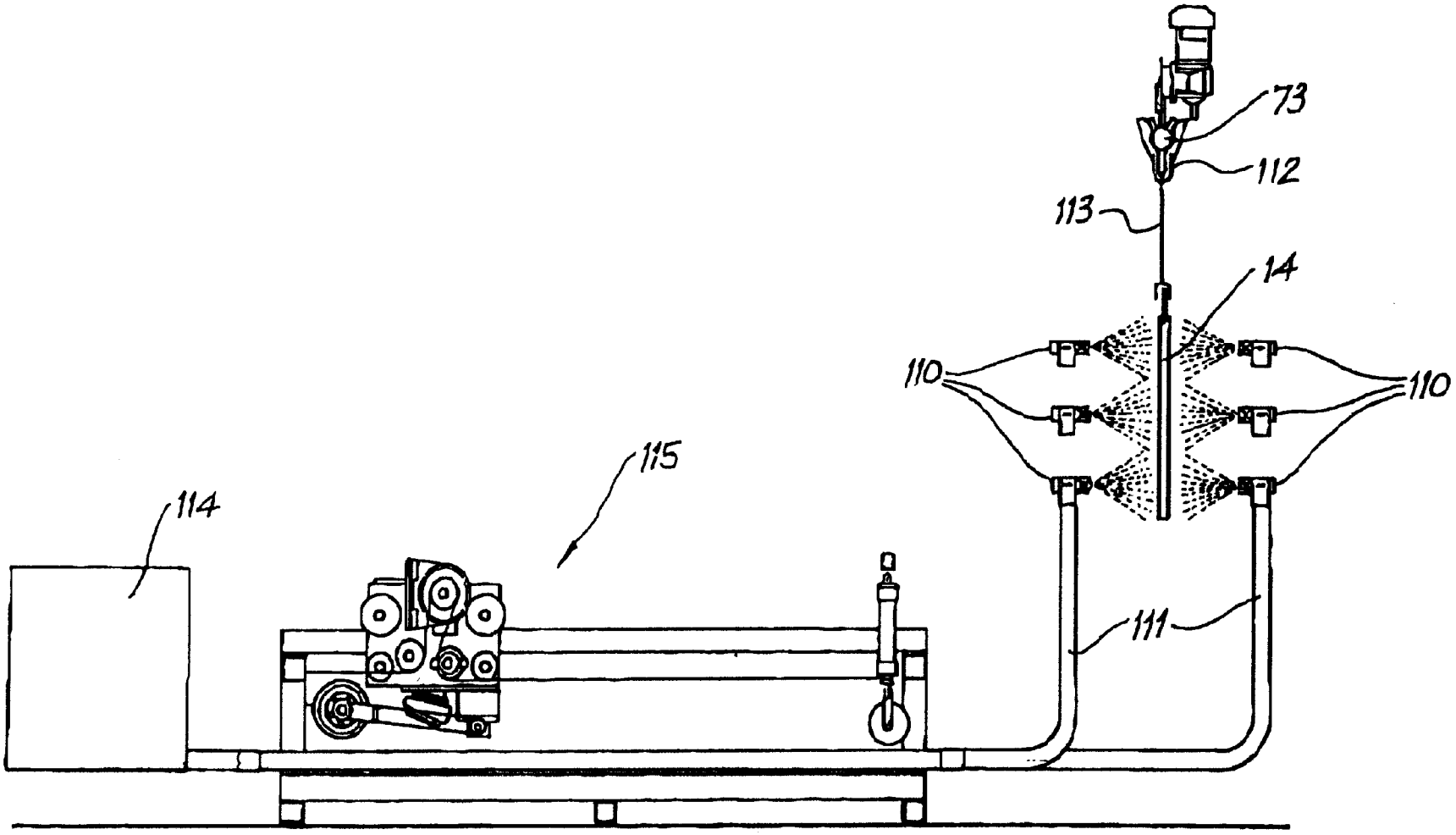
FIG. 11 is a schematic elevational view of a spray assembly and associated pumping apparatus.

In FIG. 11 there is shown the detail of a method of simultaneously spraying both sides of a solid baffle 14. The spray assembly includes a plurality of spray guns 110 positioned at both sides of the baffle 14. The baffle 14 is drawn by the pipe conveyor 73 inbetween the spray guns 110 during spraying so as to achieve a uniform coating on each side. A carriage 112 is associated with the pipe conveyor 73 in somewhat the same manner as a curtain ring is associated with a curtain rod. The carriage is pulled along the pipe conveyor by a cable or chain. A cable 113 suspended from the carriage 112 includes hooks 103 (FIG. 10A) which engage with the projections 102 of each baffle to suspend and convey the baffle 14.

Also shown in FIG. 11 is a coating material pump 114 which provides a head of a coating material to a coating material metering and delivering apparatus 115. The metering and delivering apparatus 115 operates like a vein pump and includes a number of wheels or rollers which pass along fixed lengths of tube through which a coating material passes. The rate at which a coating material is delivered to the spray nozzles 110 can be adjusted by altering the distance of travel of the rollers along the lengths of tube, by altering the length of tube, or by altering the diameter of the tubes.

Figure 11A:
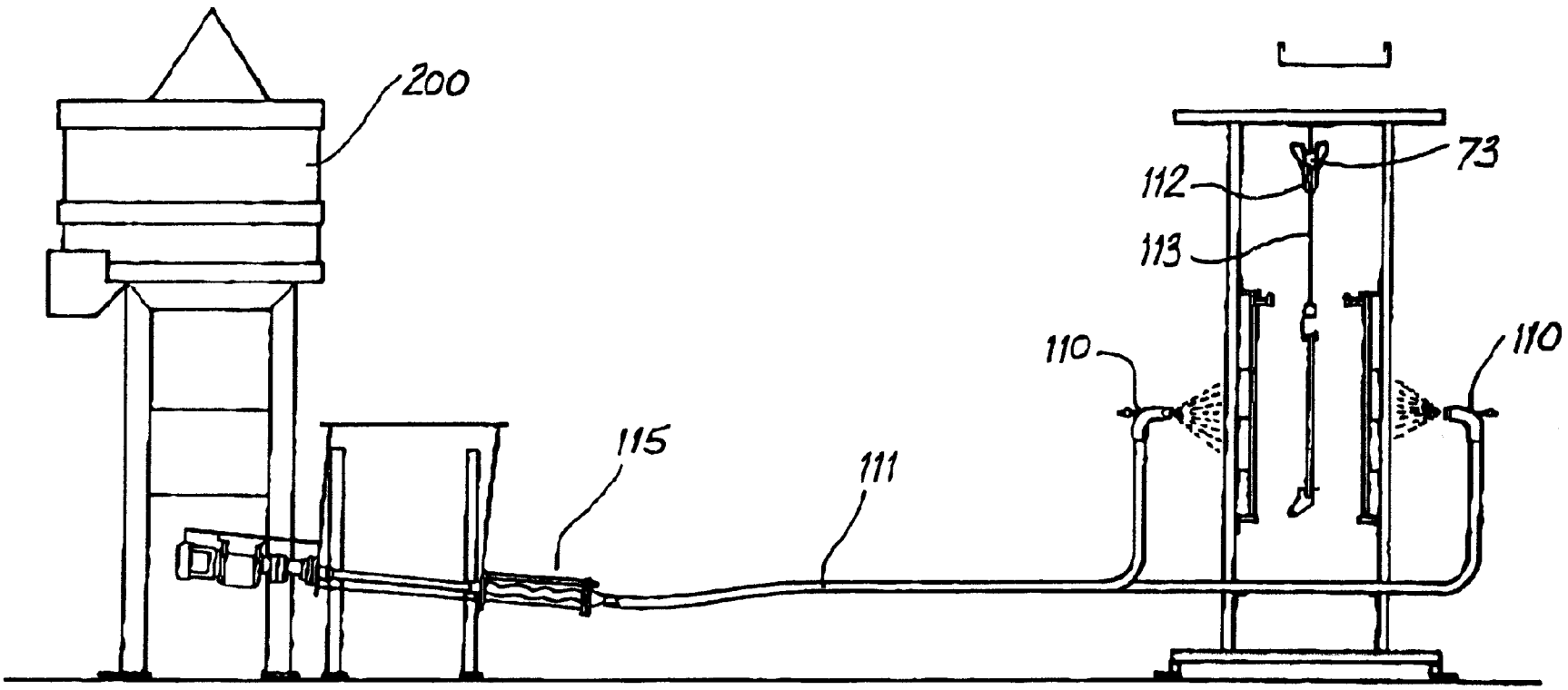
FIG. 11A is a schematic elevational view of another spray assembly and its associated pumping apparatus.

In FIG. 11A, a baffle spraying apparatus is shown associated with a different type of pumping apparatus. The individual baffles 14 are sprayed on both sides with the coating material mixture. The mixture is predominantly a water, sand, cement, flyash, fibre, polymer, and other concrete additive blend. It is prepared in a mixer 200. The mixer 200 delivers the coating material mixture to a pump 115. The pump 115 delivers the mixture via hoses 111 to the spray guns 110. The mixture which is under pressure is sprayed by the guns 110 onto the baffles 14. The mixture then coats the vertical surfaces of the baffles 114.

Figure 12:
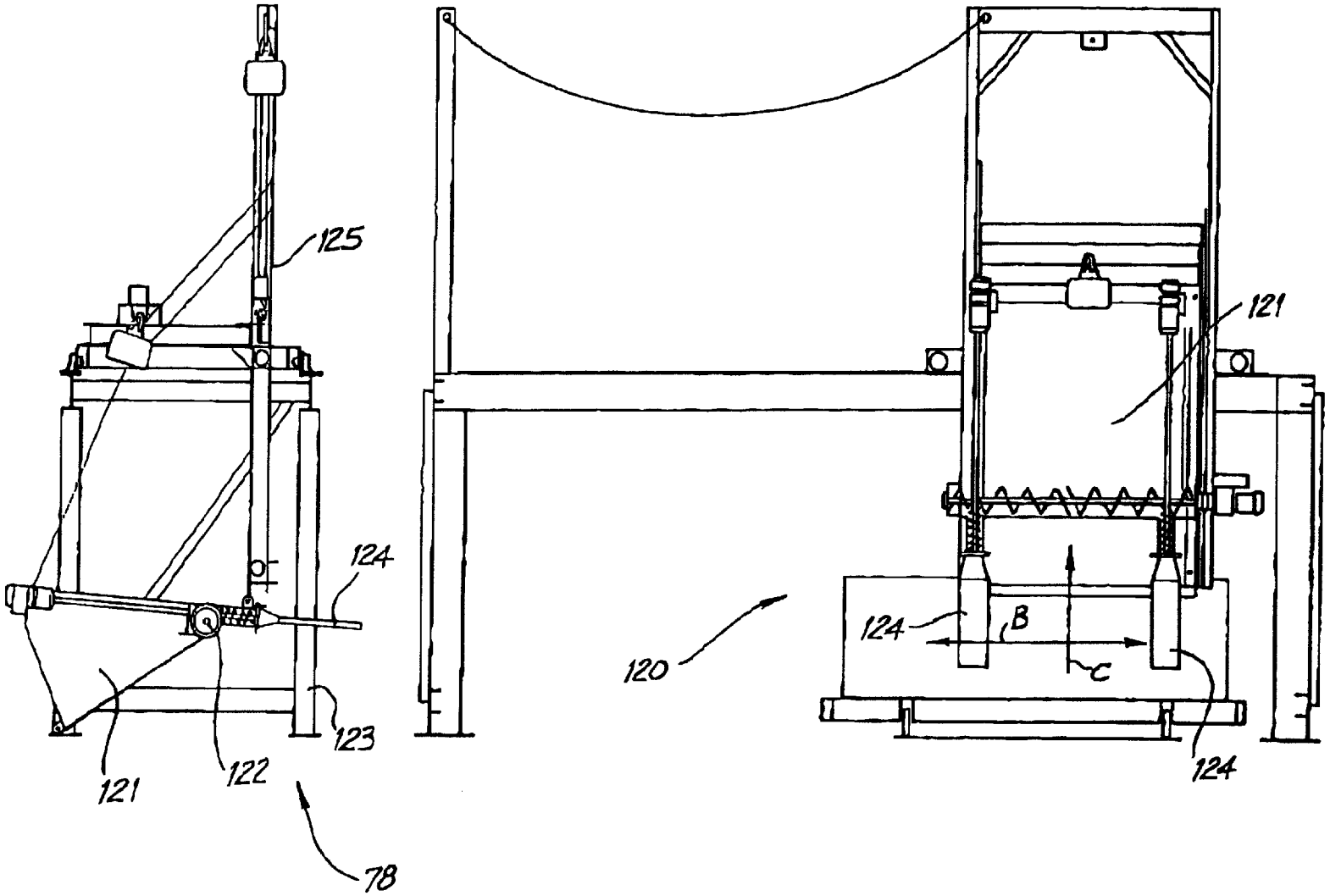
FIG. 12 is a schematic elevational view of concrete core filling apparatus.

In FIG. 12 there is depicted a baffle supporting frame 120 and associated core filling apparatus 78. The core filling apparatus 78 includes a hopper 121 which is filled with sufficient core material to fill the space between all baffles in the baffle supporting frame 120. The hopper 121 is pivotally mounted at 122 to a frame 123. Extending from the hopper 121 is a pair of filling tubes 124 through which core material from the hopper can pass. The hopper 121 and filling tubes 124 are adapted to be drawn vertically upwardly along a track 125 by means of a hoist. Once raised into a position wherein the filling tubes 124 are vertically clear of the baffles in the cavity box, the hopper can be pivoted vertically about pivot axis 121 into the vertical position depicted at the right in FIG. 12. Alternatively, the hopper can be pivoted prior to lifting. By means of the hoist, the hopper 121 can be lowered such that the tips of the fill tubes (which are now extended downwardly from the hopper) are nearby the bottom of the mould box or supporting frame between a pair of baffles. Means are provided for oscillating the hopper 121 from side-to-side in the direction indicated by arrow B whilst raising the hopper 121 and nozzles 124 in the direction indicated by arrow C. The means for providing the oscillation in the direction of arrow B can be camshafts, solenoids, pneumatic rams, hydraulic rams or other oscillation mechanisms. The aim is to fill the space between the baffles with core material at a controlled rate. That is, the rate of delivery of the core material is adjusted such that the core is filled at the same rate as the rate at which the nozzles are vertically withdrawn from the mould box or supporting frame. This controlled rate of filling prevents the core material from shearing a coating material from the baffle surfaces during the filling process. Once space between a pair of baffles is filled, the mould box or supporting frame is shifted along so as to align the next, empty cavity with the filling tubes whereupon the filling tubes are lowered with hopper 121 and the process continued. It should be noted that the hopper 121 and the fill tubes 124 oscillate backwards and forwards in the direction indicated by arrow B during vertical withdrawal such that the tips of each fill tube 124 follow a sinusoidal path. This method of filling also prevents the encapsulation of air pockets in the core.

Figure 12B:
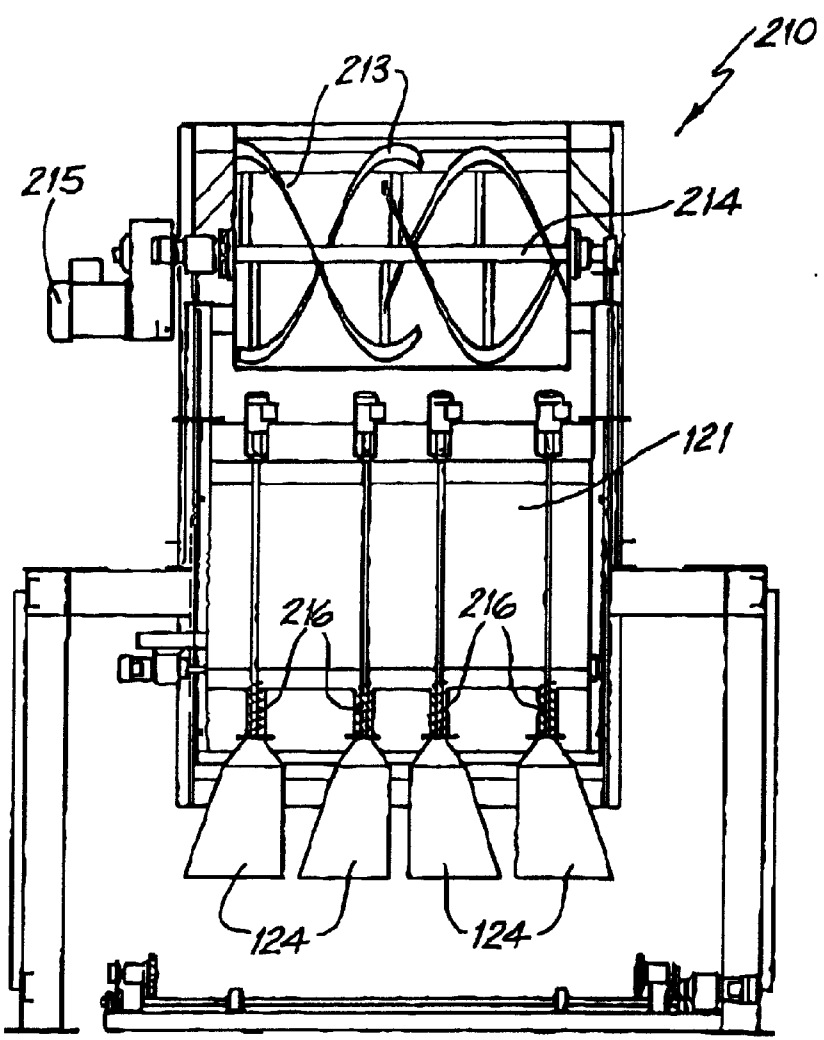
FIG. 12B is a schematic front elevational view of the apparatus of FIG. 12A.
Figure 12A:
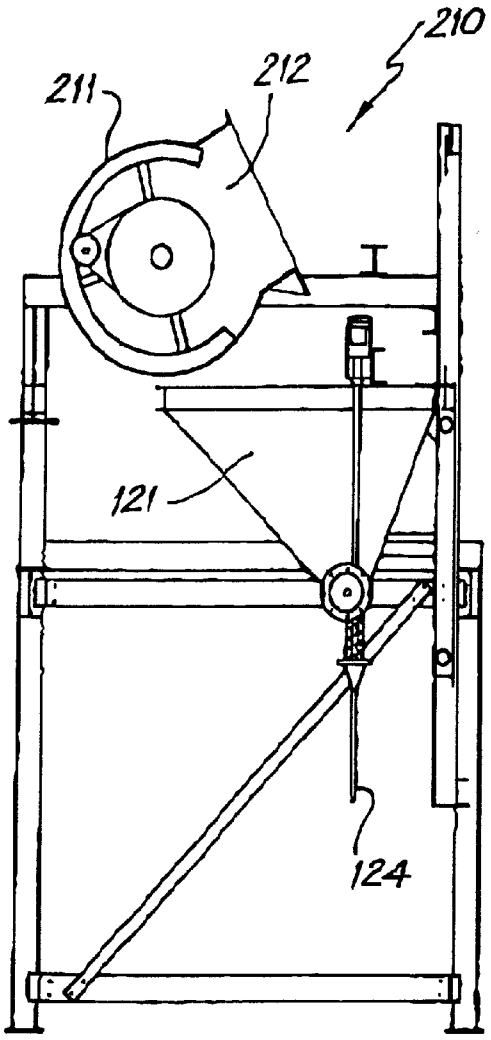
FIG. 12A is a schematic end elevational view of another concrete core filling apparatus.

In FIGS. 12A and 12B an alternative core filling station is depicted. Once the moulds are assembled with the settable coating material on each face of the baffles, they are moved into the filling station depicted. The filling station places the core mixture in the moulds, filling the space between each baffle. The core mixture is predominantly a water, cement, flyash, modified and coated EPS, polymer, and other concrete additive blend. The core mixture is prepared and mixed in a core mixer 210 mounted upon a frame above hopper 122. The core mixture is then delivered to the hopper 122. The core mixture is delivered from the hopper 122 via the nozzles 124 into the moulds. The hopper 122 and nozzles 124 move in such a manner that the core mixture is placed into each individual space between mould leaves until the entire mould is filled. The moulds are then stored for an adequate period of time to allow partial curing and hardening of the panels. The mixer 210 includes a horizontally oriented substantially cylindrical mixing tub 211 having an opening 212 through which ingredients pass for mixing in the tub 211. A helical blade or blades 213 are located upon a rotating shaft 214 which is driven by an external motor 215. The tub 211 is pivotally mounted upon a shaft which is common or coaxial with the shaft of the mixing blades. The tub 211 can pivot so as to allow delivery under flow of the mixed material to the hopper 122.

The nozzles 124 receive the core material from the hopper 122 by a device such as an auger 215 or other pumping device.

Figure 13:
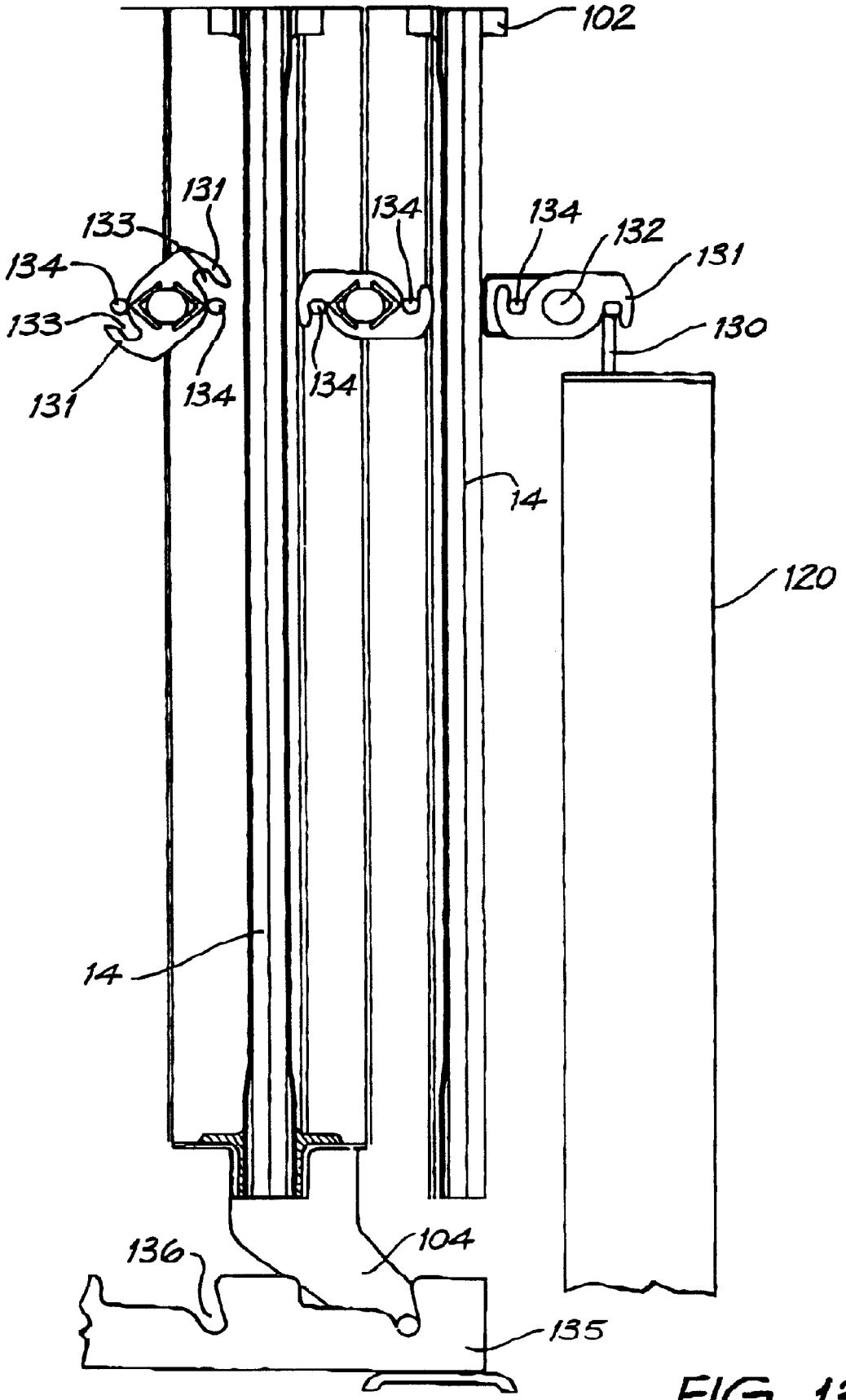
FIG. 13 is a schematic end elevational view of a mould release system.

In FIG. 13 there are shown first and second baffles 14 alongside the side wall of the baffle supporting frame 120. The upper edge of the sidewall includes a vertically projecting pin 130 which cooperates with a baffle locking pin 132. The baffle locking pins 132 each include a pair of legs 131, each defining recesses 133 into which lugs 134 projecting from the ends of each baffle are received. The distance between the recesses 131 defines the spacing between the baffles 14 and thus the thickness of the panels produced. The locking pin 132 at the right hand side shown in FIG. 13 cooperates with the vertically projecting pin 130 to define the position of the first baffle 14. The locking pins as well as the interaction of the lugs 104 with the bottom of the baffle supporting frame 120 rigidly secure each baffle in place. Also shown in FIG. 13 is a locating track 135 at the bottom of the mould box or supporting frame and defining recesses 136 into which the lugs 104 are received. The locking pins 132 are positioned so as to extend into the space between each baffle and are twisted by a mechanical means through 90° to engage the recesses 133 over the respective pins 134.

Figure 13A:
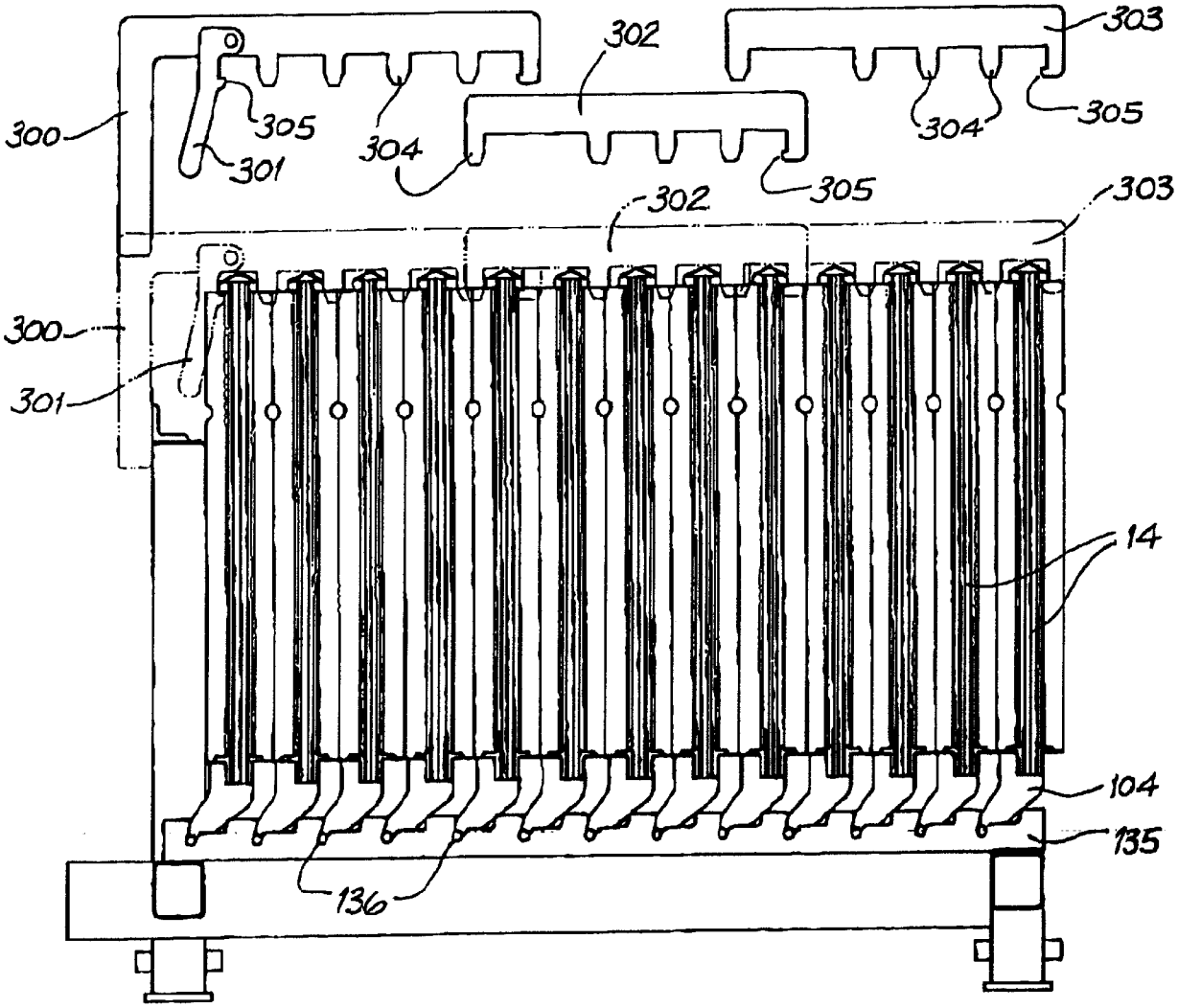
FIG. 13A is a schematic end elevational view of another mould release system.
Figure 13B:
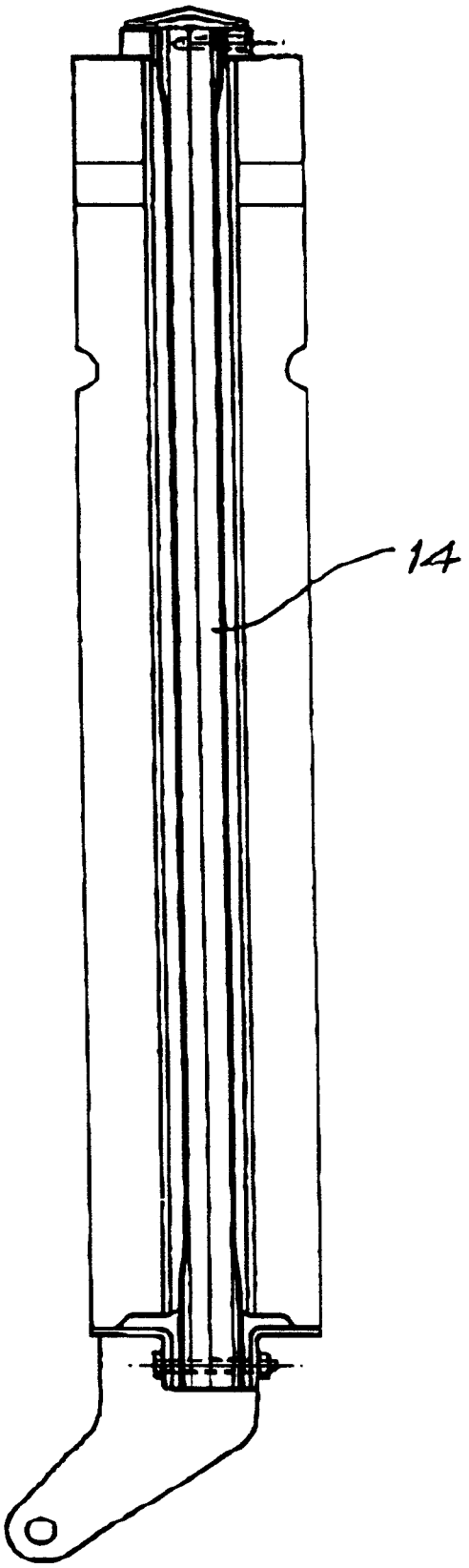
FIG. 13B is a schematic end elevational detail of part of the mould release system of FIG. 13A, and FIGS. 14 and 14A are schematic partial elevational views of finished panels.

In FIG. 13B, there is shown in more detail one of baffles 14. The baffles are a composite involving plywood, nylon, PVC, and steel. The manufacturing process involves the automation-assisted assembly, filling and de-assembly of the moulds.

After setting of the core material, the locking pins 132 are rotated through 90° in the opposite direction to enable release of each panel for conveying out of the mould box or supporting frame.

In FIG. 13A there is shown apparatus alternative to that shown in FIG. 13. Instead of the apparatus indicated by reference numerals 130, 131, 132, 133 and 134, a plurality of locking clamps 300, 302 and 303 are provided. Each locking clamp has a plurality of downwardly depending lugs 304 which, in cooperation with the upper edge of each baffle defines the baffle spacing. Features at the lower end of each baffle are substantially identical with those as described above with reference to FIG. 13. A locking handle 301 is pivotally connected to the locking clamp 300 and includes a tab 305 to engage with features provided at the upper edge of each baffle. A similar tab 305 is provided at the remotely located depending lug of each locking clamp. By use of the apparatus of FIG. 13A, after being sprayed, each individual baffle is moved along the monorail to the mould assembly station. At the mould assembly station, the baffles are assembled into the mould frames and locked into position with the locking clamps otherwise known as "mould combs".

An important distinction between the baffles of the process of FIGS. 7 to 13 to that of FIGS. 1 to 6A is that it is no longer necessary to apply air to release panels from the baffles. This is due to the fact that the baffles are solid. Also, there is no need to apply lateral force to each baffle to position the same as described with reference to FIGS. 1 to 6.

Also, a hand-held pneumatic cylinder is not used in the plant of FIGS. 7 to 13 to remove the panels from the mould box or supporting frame. Rather, each baffle is sequentially moved sideways and lifted from the mould box or supporting frame using a lifting system as described earlier.

What is claimed is:

1. A method of forming a building panel or panels, the method including:

applying a flowable, settable coating material to respective surfaces of at least two baffles, placing the baffles in a substantially parallel, spaced interrelationship, at least substantially filling the space between the two baffles with a settable core material prior to setting of the coating material, and allowing the core material and coating material to set.

2. The method of claim 1 wherein the baffles are located with respect to one another prior to filling the space with core material.

3. The method of claim 1, wherein the baffles are moved together after filling the space with core material but prior to setting of the core material and coating material.

4. The method of claim 1, wherein the baffles are moved apart and/or separately removed after setting of the core material and coating material so as to release the formed panel(s).

5. The method of claim 1 providing n+1 baffles in a parallel spaced interrelationship, between which n panels are formed where n equals any integer greater than or equal to 1.

6. The method of claim 4 wherein after the baffles are moved apart, the panels are removed in a direction substantially parallel to the plane of the baffles by application of force thereto.

7. The method of claim 1, wherein the baffles are located within a mould box or supporting frame.

8. The method of claim 1, wherein the baffles are moved toward one another by means of hydraulic clamping cylinders.

9. An apparatus for use in forming a building panel or panels by the method of claim 1, the apparatus including:

a mould box or supporting frame into which said coated baffles are receivable, means to locate said coated baffles in association with one another so as to define a minimum space therebetween, and means to apply a settable core material between each of said baffles.

10. The apparatus of claim 9, further including a means to apply a coating material to both sides of at least some of said baffles prior to applying said settable core material between each of said baffles.

11. The apparatus of claim 9, wherein each baffle is substantially hollow, having a pair of spaced apart side sheets.

12. The apparatus of claim 11, wherein each baffle has air inlet means by which air can be injected into the space between the sheets so as to outwardly expand the same under pressure to assist in releasing the set panels from the baffles.

13. The apparatus of claim 9, wherein each baffle is solid.

14. The apparatus of claim 9, wherein the baffles have extraction engagement holes to which an extraction device can be anchored for the purpose of applying force to the set panels for removal.

15. The apparatus of claim 9, wherein the mould box or supporting frame is formed upon a mobile structure.

16. The apparatus of claim 15, wherein the mobile structure has one or more posts to which clamping cylinders are affixed, said clamping cylinders being associated with said walls of the mould box or supporting frame.

17. The apparatus of claim 16, wherein the side walls of the mould box or supporting frame act as end baffles.

18. A plant for forming building panels, the plant including:

means for applying a flowable, settable coating material to respective surfaces of at least two baffles, means for placing the baffles in a substantially planar, spaced interrelationship, means for substantially filling the space between the two baffles with a settable core material prior to setting of the coating material, and means for conveying the individual panel throughout the plant for the purpose of cleaning and coating the same with said settable coating material and for arranging the coated baffles in said substantially parallel, spaced interrelationship.

19. The plant of claim 18, including means for conveying a mould box or supporting frame into which and from which the baffles are inserted and removed and means for transferring the mould box or supporting frame from a first, baffle removal position to a second, baffle insertion position, between which positions the mould box or supporting frame is rotated.

20. The plant of claim 18, wherein the means for substantially filling the space between the two baffles with a settable core material includes a hopper from which there extends one or more filling tubes, the hopper being mounted upon a frame and being pivotable about a horizontal axis, the hopper being adapted to be raised and lowered such that the filling tubes enter and are withdrawn from a space between adjacent baffles while core material is being delivered thereto by said filling tubes.

21. The plant of claim 18 wherein means are provided to oscillate the hopper horizontally, during vertical withdrawal of the tubes and delivery of the core material.

* * * * *